US009655449B2

(12) United States Patent
Grabher et al.

(10) Patent No.: US 9,655,449 B2
(45) Date of Patent: May 23, 2017

(54) WALL CONSTRUCTION ELEMENT, DRAWER HAVING SUCH A WALL CONSTRUCTION ELEMENT, AND ITEM OF FURNITURE

(71) Applicant: Grass GmbH, Hoechst (AT)

(72) Inventors: Guenter Grabher, Fussach (AT); Juergen Amann, Lustenau (AT); Patrick Pirker, Fussach (AT)

(73) Assignee: Grass GmbH, Hoechst (AT)

( * ) Notice: Subject to any disclaimer, the term of this patent is extended or adjusted under 35 U.S.C. 154(b) by 0 days.

(21) Appl. No.: 14/882,583

(22) Filed: Oct. 14, 2015

(65) Prior Publication Data

US 2016/0106212 A1 Apr. 21, 2016

(30) Foreign Application Priority Data

Oct. 16, 2014 (DE) ..... 20 2014 104 926 U

(51) Int. Cl.
*A47B 88/04* (2006.01)
*A47B 96/20* (2006.01)
(Continued)

(52) U.S. Cl.
CPC ..... *A47B 96/20* (2013.01); *A47B 88/40* (2017.01); *A47B 88/956* (2017.01);
(Continued)

(58) Field of Classification Search
CPC ..... A47B 96/20; A47B 96/201; A47B 88/04; A47B 88/0044; A47B 88/0055; A47B 2210/01; A47B 2210/02; A47B 2210/0002
See application file for complete search history.

(56) References Cited

U.S. PATENT DOCUMENTS 5,252,190 A * 10/1993 Sekiguchi ..... A23L 3/3427 204/157.3
5,478,146 A * 12/1995 Grabher ..... A47B 88/0014 312/348.1
(Continued)

FOREIGN PATENT DOCUMENTS

DE 20 2008 009 507 U1 11/2008
WO 2007/137311 A2 12/2007
WO 2009/006651 A2 1/2009

OTHER PUBLICATIONS

Extended European Search Report (Application No. 15187919.4) dated Mar. 2, 2016.
(Continued)

*Primary Examiner* — Daniel Rohrhoff
(74) *Attorney, Agent, or Firm* — Burr & Brown, PLLC

(57) ABSTRACT

A wall construction element of a drawer is proposed, wherein the wall construction element has a frame body, having a base part which provides a cavity for receiving a drawer guide system, and having a casing element for casing the base part, wherein in a covering portion of the frame body a material layer of the casing element covers a material layer of the base part. According to the invention, a support part which upwardly projects in the fashion of a column is present on the frame body, wherein for attaching the support part in an end-side end region of the frame body a tongue-like flat portion of the support part is secured between the base part and the casing element.

13 Claims, 2 Drawing Sheets

(51) Int. Cl.
*A47B 88/956* (2017.01)
*A47B 88/40* (2017.01)

(52) U.S. Cl.
CPC ... *A47B 2210/0002* (2013.01); *A47B 2210/01* (2013.01); *A47B 2210/02* (2013.01)

(56) References Cited

U.S. PATENT DOCUMENTS

| | | | | | |
|---|---|---|---|---|---|
| 5,536,083 | A * | 7/1996 | Brustle | A47B 88/04 | 312/334.12 |
| 5,992,958 | A * | 11/1999 | Scheible | A47B 88/0014 | 312/330.1 |
| 6,095,627 | A * | 8/2000 | Sutterlutti | A47B 88/0014 | 312/263 |
| 2004/0000852 | A1* | 1/2004 | Lam Harn | A47B 88/0055 | 312/348.4 |
| 2009/0058243 | A1* | 3/2009 | Weber | A47B 88/0055 | 312/348.4 |
| 2010/0102692 | A1 | 4/2010 | Hämmerle | | |
| 2016/0106211 | A1* | 4/2016 | Grabher | A47B 88/0085 | 312/334.8 |
| 2016/0106213 | A1* | 4/2016 | Grabher | A47B 96/20 | 312/334.7 |

OTHER PUBLICATIONS

German Search Report (Application No. 20 2014 104 926.6) dated Aug. 27, 2015.

* cited by examiner

WALL CONSTRUCTION ELEMENT, DRAWER HAVING SUCH A WALL CONSTRUCTION ELEMENT, AND ITEM OF FURNITURE

This application claims the benefit under 35 USC §119 (a)-(d) of German Application No. 20 2014 104 926.6 filed Oct. 16, 2014, the entirety of which is incorporated herein by reference.

FIELD OF THE INVENTION

The present invention relates to a wall construction element, a drawer having such a wall construction element, and an item of furniture.

BACKGROUND OF THE INVENTION

Wall construction elements of a drawer, such as a drawer side wall or a drawer frame, respectively, in particular cavity frames for drawers, which in substantial regions have hollow portions, are known from the prior art.

Cavity frames, in particular, are made of a metal and/or a plastics material and offer the advantage that a drawer guide system, or a guide unit having two or three mutually telescopically deployable rails, respectively, may be accommodated in the hollow portions, on account of which construction height may be saved, for example, when compared with a solid side wall made of wood, for example, the guide which is attachable thereto in an adjacent manner requiring laterally thereof and below thereof, respectively, additional installation space.

In the manufacture of the wall construction elements which are designed as cavity frames, a desired design of the cavity frame has also to be considered alongside constructive compatibility for accommodating the guide unit. Both the multiplicity of guide units which are conceived in various designs as well as the various variants of design of the wall construction elements lead to a comparatively high complexity when providing respective wall construction elements.

SUMMARY OF THE INVENTION

It is an object of the present invention to provide in a technically and economically advantageous manner a wall construction element or a drawer of the type explained at the outset, respectively, in particular with a view to manufacturing wall construction elements from individual components while applying proven process techniques, in order for desired properties to be achieved in the manufactured item.

The invention initially proceeds from a wall construction element of a drawer, in particular a drawer frame, wherein the wall construction element has a frame body, having a base part which provides a cavity for receiving a drawer guide system, and having a casing element for casing the base part, wherein in a covering portion of the frame body a material layer of the casing element covers a material layer of the base part. The covering portion or the respective material layers of the base part and of the casing element, respectively, in the state of use may be oriented so as to be horizontal, vertical, and/or oblique.

The core of the invention lies in that a support part which upwardly projects in the fashion of a column is present on the frame body, wherein for attaching the support part in an end-side end region of the frame body a tongue-like flat portion of the support part is secured between the base part and the casing element. In this way, a particularly stable connection and an arrangement of the support part and of the frame body which is capable being advantageously assembled is provided.

The frame body extends in particular across an entire or a substantial spacing between a front element of the drawer and a rear wall of the drawer. At least parts of mutually opposite side regions of the drawer are thus formed by two respective frame bodies. A spacing in the longitudinal direction or direction of movement which exists between the inner sides of the front element and the rear wall is spanned by the frame body. Moreover, the frame body is configured so as to configure a connection between the front element and the rear wall and moreover a drawer base.

Coupling to the front element is performed in the front end region of the frame body, and coupling at the rear wall is performed in the rear end region of the frame body. Connecting to the drawer base is performed so as to be continuous or advantageously at a plurality of points across the length of the frame body. The frame body, which in particular is elongate and is of sheet metal that is bent in an angular fashion, for example, in the vertical extent has a lesser height than the front element and/or the rear wall. This makes it possible for the lateral region above the frame body to be left partially or entirely exposed or for a selected capping to be provided above the frame body. Various design and/or construction variants may be implemented on the frame body with the capping, for example, by selecting a desired capping from a multiplicity of variously designed and matching cap-type parts. All cappings are uniformly designed in a matching fashion for attachment to the frame body. This is advantageous for individualizing identical basic components. The frame body is in particular designed in such a manner that the drawer guide system is accommodatable in a matching manner in a cavity region of the frame body. The frame body is in particular designed so as to accommodate in a fashion matching the frame body any of a plurality of guide units which have been conceived in various manners and which are in each case configured having a uniform attachment concept.

The support part serves for coupling the frame body to the front element or the rear wall, respectively. In order for the frame body to be able to be connected in a sufficiently stable manner to various types or dimensions of the front element or the rear wall, respectively, a front and a rear support element are typically to be secured to the frame body. Forces are absorbed or transmitted, respectively, between the front element and the rear wall, respectively, by way of the respective support part. These forces are also influenced by weight-related forces which act on the drawer base on account of the load in a drawer and thus also have an effect on the frame body. It is thus necessary for the connection of the support part to the frame body to be set up so as to be comparatively stable and reliable. From the point of view of static and dynamic considerations, those regions which are critical in terms of failure have to be determined in particular in the connection regions of components.

The arrangement according to the invention advantageously provides a highly stable connection arrangement. Moreover, a multi-layered arrangement which is compact and delivers high stability values in a mechanically advantageous manner is implemented by way of the proposed connection structure.

It is further proposed that the flat portion forms a material layer of the support part, which is present in an intermediate region between the material layer of the base part and the material layer of the casing element in the covering portion.

In this way, a particularly compact, stable and pre-secured arrangement is achieved. The material layers are in particular flat sheet-metal portions which have been formed in particular by bended features on the respective parts.

The portions to be connected on the support part, the base part, and on the casing element are in particular made of a weldable metal material or of flat sheet-metal portions, respectively, which bear on one another in a planar manner. Here, a central sheet-metal layer or a material layer, respectively, advantageously comes to bear in planar manner in each case laterally or at the top and the bottom, respectively, on mating faces of the other adjacent sheet-metal layers or material layers, respectively. In this way, a multi-layered sandwich structure, or in particular a triple-layered sheet-metal laminate, respectively, is formed in the connection region in the covering region. Advantageously, the plurality of layers may in this way be mutually interconnected in one operational step, in particular be mutually interconnected in a uniform and comprehensive or form-fitting manner, respectively. Furthermore, in this way an advantage in terms of stability in comparison with other connections is achieved by the compact or mutually supportive connection of the at least three material layers, respectively.

The support part in a transverse manner to the length of the frame body is adapted in its width, in particular adapted to the width of the frame body, and in the longitudinal frame-body direction extends across only a comparatively minor part of the total length of the frame body, for example across approx. 10% thereof, or across approx. one centimeter to a few centimeters, respectively.

The height of the protrusion of the support part which is attached to the frame support above an upper side of the frame support is selected by means of criteria pertaining to connections and stability, respectively, and ranges at maximum up to a height which corresponds to a height of an upper edge of the front element, or a height of an upper edge of the rear wall, respectively.

The support part which is in particular elongate and slight, having a column-like or bar-like basic body, for example, for assembly of the wall construction element is in particular attachable to the completed frame body.

The tongue-like flat portion of the support part may be inserted at the front and/or rear end-side end region of the frame body, advantageously for example in a gap region between the base part and the casing element, and be secured therein.

It is moreover advantageous that a first side of the flat portion of the support part in a connection region is connected in a planar manner to a material layer of the base part, and a second side of the flat portion of the support part is connected in a planar manner to a material layer of the casing element. This leads to a particularly compact and stable connection.

The first side of the flat portion is in particular present so as to be opposite the second side of the flat portion and as to be spaced apart by way of the thickness of the material layer. Mutual bearing is effected in particular in a planar manner or by way of mutual contact of the faces, respectively. The material layers are connected in an overlapping manner, for example in the manner of a sandwich structure having in particular two or three layers. It is not to be excluded that more than three layers are present. For example, the tongue-like flat portion may have two material layers which are mutually spaced apart so as to correspond to the thickness of the material of the base part and/or of the casing element, for example, the material layer of the base part and/or of the casing element being sufficiently present there between in the connected state of the support part.

The flat portion is advantageously secured in a material integral manner between the base part and the casing element. In the case of sheet metals, a welded connection, a soldered/brazed connection, or an adhesive connection is to be considered in particular. A welded connection may be performed in particular by roller-seam welding or by butt-welding.

One advantageous modification of the subject matter of the invention is distinguished in that a mechanically reinforced region in the covering portion which in relation to regions which are adjacent to the covering portion has an increased material thickness is provided by way of material layers which are connected in an overlapping manner. The material thickness in the covering region or in the connection region, respectively, results from the addition of thickness of the mutually overlapping material layers, in particular of the material layers of the support part, the base part, and the casing element which are interconnected by a materially integral method. In this way, increased mechanical stability may be advantageously provided in the construction-element portions of the wall construction element which are particularly stressed during operation of the drawer.

It is moreover advantageous that the flat portion is present between an upper side of the base part and an upper side of the casing element. In particular, the respective upper sides in the installed state are horizontally oriented portions, for example of strip shape, on the corresponding construction elements. In the pre-fabricated frame body without the support part, the upper side of the base part and the upper side of the casing element are in particular spaced apart by a gap, in particular in the vertical direction, such that the tongue-like flat portion of the support part is insertable in a matching manner, optionally in a contacting manner, prior to fixed securing being performed by way of materially integral connecting, for example.

Alternatively or additionally to the end-side flat portion which projects in a horizontal manner, the tongue-like flat portion of the support part may also be configured on lateral and vertical portions on the base body of the support part. The lateral flat portion may be inserted in a respective gap between the base part and the casing element if and when the base part and the casing element are mutually overlapping in a mutually spaced apart manner in this region. The flat portion then is open toward the bottom, for example, and formed in a contiguous U-shaped manner or by two or three mutually separated portions which are aligned so as to be mutually oriented in an angular manner.

Advantageously, the flat portion of the support part is configured in a lower end region of a base body of the support part. It is particularly advantageous that a lower end or a periphery of the base body, respectively, projects in an angular manner and forms the flat portion, for example by way of a sheet-metal periphery of the support part which is bent over.

It is furthermore proposed according to an advantageous variant of the invention that the flat portion of the support part is adapted to dimensions of an upper side of the frame body. In particular, the flat portion of the support part is adapted such that the flat portion in the width is approximately a width of an upper side of the frame body. In this way, the flat portion may overlap the base part by way of the width of the upper side of the latter. In a transverse manner thereto, the length of the flat portion may be established depending on the desired total area of the overlap. The flat portion is advantageously present so as to project the base body in an angular manner by a few millimeters or a few centimeters, respectively.

It is also advantageous that the support part per se, or a coupling part which is present on the support part, is configured for establishing a releasable connection to a wall construction element of the drawer, such as a front part or a rear wall part, which is oriented so as to be transverse to the frame body. In this way, the connection to further elements of the drawer may be implemented in an advantageous manner.

A further advantageous variant of the invention is characterized in that when viewed in the longitudinal direction of the frame body a support part is present in a front and/or a rear portion of the frame body. In this way, a front element and/or a rear wall can be advantageously connected with the wall construction element.

The support part is advantageously configured to be coupled to a cap-type wall element which is releasably attachable to the frame body. The support part and the cap-type wall element are adapted to mutually form a latching connection, for example, in the completely assembled side wall. The cap-type element may surround or cover the frame body including the support part, respectively, in the fashion of a housing, for example, wherein the outside of the cap-type wall element forms the entire of the external appearance of the side wall of the drawer, or part thereof, in the state of final use. The cap-type wall element advantageously extends across the entire length between a front element and a rear wall of the drawer above the upper side of the frame body up to at maximum a height which is level with an upper edge of the front element or of the rear wall of the drawer.

The invention moreover relates to a drawer having a wall construction element according to one of the variants of configuration discussed above. The drawer in this way is advantageously provided as explained, in particular having a cavity frame of metal which is capable of being assembled from individual components.

The invention moreover relates to an item of furniture having a drawer designed in the above-described manner.

BRIEF DESCRIPTION OF THE DRAWINGS

The invention will be explained in more detail in the following, stating further features and advantages.

DETAILED DESCRIPTION OF THE INVENTION

Figure 1:
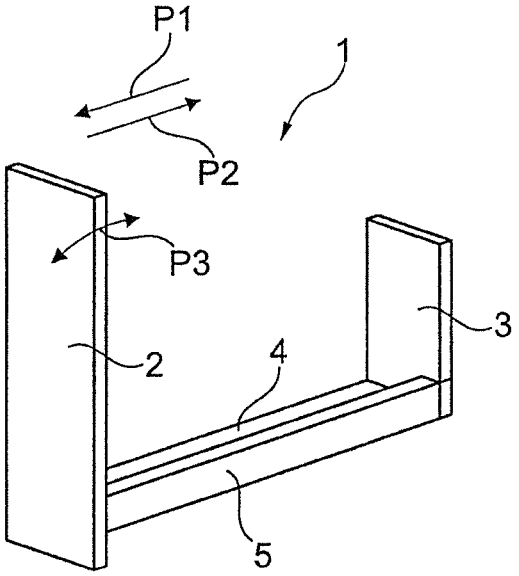
FIG. 1 shows a detail of a partially formed drawer without a support body, in a perspective view.
Figure 2:
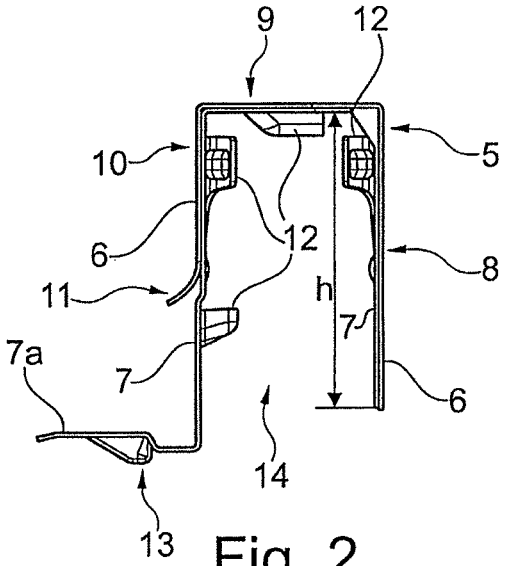
FIG. 2 shows a frame body according to the detail shown in FIG. 1, in a front view.
Figure 3:
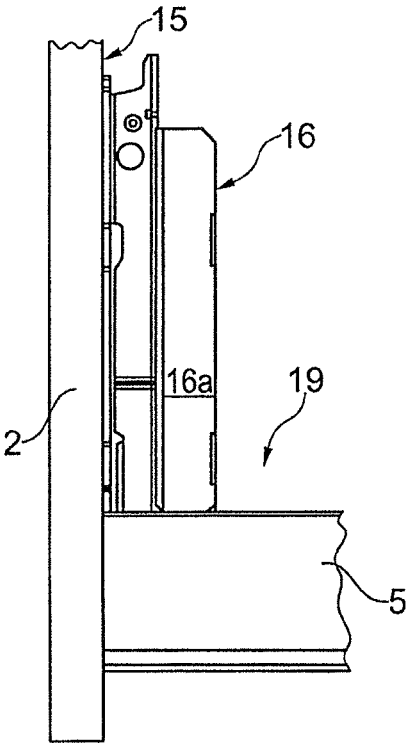
FIG. 3 shows a partial detail of the drawer according to FIG. 1, but having a support body, in a side view.
Figure 4:
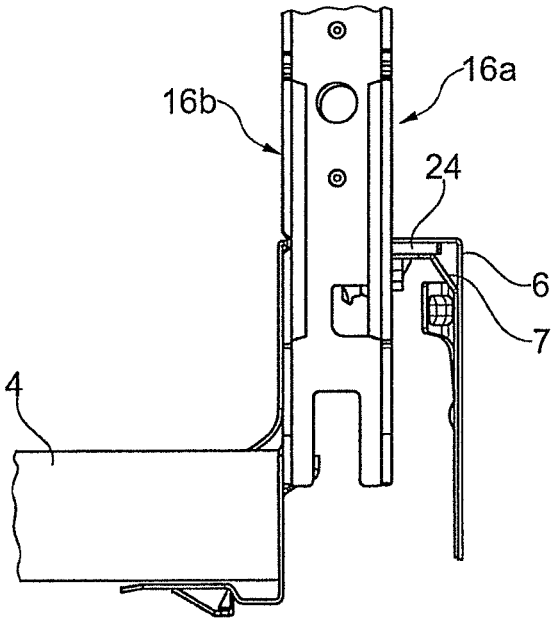
FIG. 4 shows the arrangement according to FIG. 3 in a detail, without a drawer front and without a receptacle part, in a front view.
Figure 5:
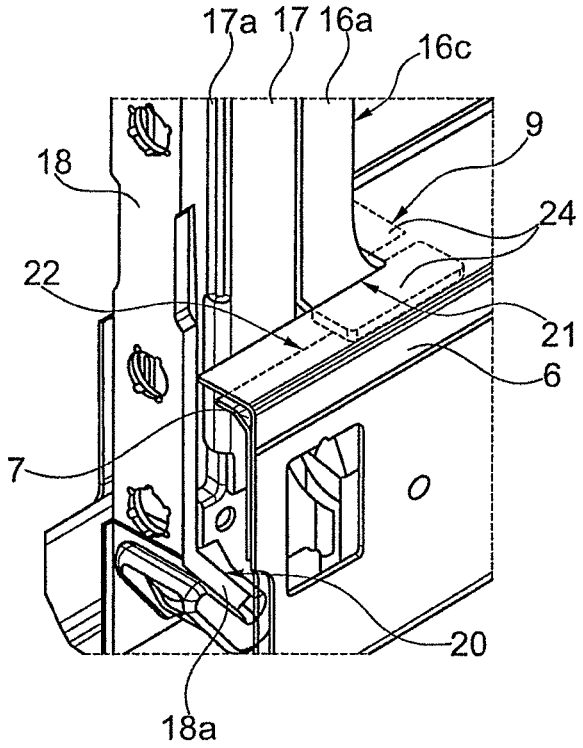
FIG. 5 shows a detail of the arrangement according to FIG. 3, without a drawer front, in a perspective view with a casing element illustrated in a transparent manner.
Figure 6:
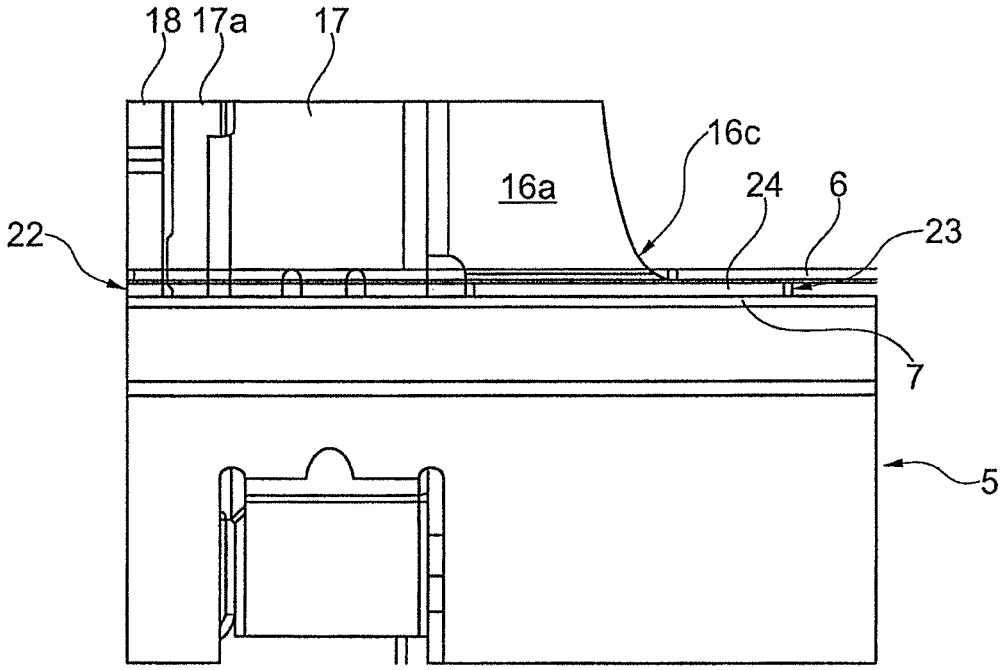
FIG. 6 shows the arrangement according to FIG. 5, in a side view.

Part of a drawer 1 according to the invention, which is formed by a longitudinal section through the drawer, having a drawer front 2, a rear wall 3, and a drawer base 4 (all in a sectional view), is shown in FIG. 1, together with a complete frame body 5 which is coupled to parts 2, 3, and 4. For the sake of clarity in terms of the fundamental construction of the drawer 1, a support body on the frame body 5, which is configured as a support console 16, is not illustrated in FIG. 1, said support console 16 however being visible in FIGS. 3 to 6. The frame body 5 in FIG. 2 is illustrated from the front.

The frame body 5 comprises an outer casing element 6 and a base part 7 which is largely received in the latter and which on the inside surrounds a cavity 14 which is open toward the bottom. The casing element 6 and the base part 7 are in each case an elongate profiled body and are in particular formed by bending machined flat sheet-metal elements. The casing element 6 covers the base part 7 in the region of an outer side 8 and of a horizontal connection portion 9 of the frame body 5 and on an inner side 10 up to a wiper blade 11 which is molded on the casing element 6 so as to be laterally and inwardly directed. Attachment installations 12 which serve for releasably securing a drawer guide system (not illustrated), such as a part-pullout or a full pullout, in the cavity 14 are provided on the base part 7, so as to project toward the cavity 14. A cabinet rail of the secured drawer guide system here reaches out of the cavity 14 and extends into the region below or beside the outer side 8, so as to establish a positionally fixed connection of the drawer guide system and thus of the drawer 1. To this end, the cabinet rail is fastened to an inner side of a side wall of a furniture cabinet (not shown), on which the drawer 1 is received so as to be movable by way of the drawer guide system in the extension direction P1 and in the retraction direction P2. A further longitudinal side of the drawer 1, which is opposite the frame body 5 and is constructed in an identical manner but is not visible, is correspondingly fastened to the inside of a further side wall of the furniture cabinet, so as to be guided in a movable manner therein.

Moreover, the base part 7 on an angular bearing face 7*a* comprises fastenings brackets 13 for the drawer base 4 which is disposed on the bearing face 7*a* so as to bear on the lower side thereof.

The casing element 6 in relation to the outer side 8 of the frame body 5 has a height of 46 millimeters, for example, whereas the height h of the base part 7 on the outer side 8 is one or two millimeters less.

In principle, the frame body 5 as a complete cavity frame could be employed as a drawer wall in a drawer according to FIG. 1.

In the present case according to FIG. 1 a comparatively large projection of the drawer front 2 in relation to the upper side or to the connection portion 9 of the frame body 5 results. The support console 16 is present in order for stable securing of the drawer front 2 to be nevertheless enabled with the aid of the frame body 5, in particular in order to counteract tilting of the drawer front 2 about a horizontal axis according to the tilting direction P3.

At the front end side, a front coupling 17 having a receptacle part 17*a* for releasably hooking a front hook 18 adjoins the support console 16. The support console 16 and the front coupling 17 are preferably fixedly connected. The front hook 18 is fastened to an inner side 15 of the drawer front 2, such that a web 18*a*, which obliquely projects downward thereon, engages in a matching slot 20 of the receptacle part 17*a*. The drawer front 2 by way of the front hook 18 may thus be hooked to the wall construction element 19 which is formed by the frame body 5 and the support console 16 including the front coupling 17.

In order for the in particular metallic support console 16 to be connected in the connection portion 9, the casing element 6 on the front end side thereof, on the upper side has a clearance 21, which when viewed from above is rectangular, and the base part 7 also has a rectangular clearance 22 of the same type.

In this way, the support console 16 and the front coupling 17 having the receptacle part 17*a* may be accommodated so as to be offset to the rear in relation to a front end side of the frame body 5. The base part 7 and the casing element 6 are assembled such that a defined vertical spacing of one to two millimeters, for example, is present at least in the connection portion 9, between the base part 7 and the casing element 6, on account of which a gap 23 is present in the region of the clearances 21 and 22. The gap 23 may be implemented by space holders, for example, which are effective outside the region of the gap 23 between the base part 7 and the casing element 6. A tongue-like flat portion 24 of the support console 16 is inserted during assembly of the wall construction element 19 in a matching manner into the gap 23 which is open at the periphery of the clearances 21, 22, and the three material layers are welded together. The three sandwich-type material layers are formed by a lower material layer of the base part 7, by a central material layer of the flat portion 24, and by an upper material layer of the casing element 6.

The flat portion 24 perpendicularly projects on a lower periphery of the support console 16, on mutually opposed and vertically extending flanges 16*a*, 16*b* and on an interdisposed rear side 16*c*. A length of the flat portion is approximately 10 millimeters or more.

By way of the upper-side and lower-side welding to the flat portion 24 to the base part 7, on the one hand, and to the casing element 6, on the other hand, a triple-layered welded connection by way of which the wall construction element 19 is connected in an inherently stabilized manner in particular in the region of the coupling of the drawer front 2, and the support console 16 is fixedly secured to the frame body 5, respectively, is provided.

LIST OF REFERENCE SIGNS

1 Drawer
2 Drawer front
3 Rear wall
4 Drawer base
5 Frame body
6 Casing element
7 Base part
7*a* Bearing face
8 Outer side
9 Connection portion
10 Inner side
11 Wiper blade
12 Attachment installation
13 Fastening bracket
14 Cavity
15 Inner side
16 Support console
16*a* Flange
16*b* Flange
16*c* Rear side
17 Front coupling
17*a* Receptacle part
18 Front hook
18*a* Web
19 Wall construction element
20 Slot
21 Clearance
22 Clearance
23 Gap
24 Flat portion

The invention claimed is:

1. A wall construction element of a drawer, wherein the wall construction element has a frame body, having a base part which provides a cavity for receiving a drawer guide system, and having a casing element for casing the base part, wherein in a covering portion of the frame body a material layer of the casing element covers a material layer of the base part, wherein at least one columnar support part projects upwardly from the frame body, wherein an end-side end region of the frame body projecting flat portion of the support part is secured between the base part and the casing element.

2. The wall construction element according to claim 1, wherein the flat portion forms a material layer of the support part, which is present in an intermediate region between the material layer of the base part and the material layer of the casing element in the covering portion.

3. The wall construction element according to claim 1, wherein the flat portion is secured between the base part and the casing element, the base part, the flat portion, and the casing element defining an integral portion.

4. The wall construction element according to claim 1, wherein the first and second projecting portions are present between an upper side of the base part and an upper side of the casing element.

5. The wall construction element according to claim 1, wherein the first and second projecting portions of the first and second support parts are configured in a lower end region of a base body of the support part.

6. The wall construction element according to claim 1, wherein the first and second projecting portions of the first and second support parts are adapted to dimensions of an upper side of the frame body.

7. The wall construction element according to claim 1, wherein at least one of the support parts and at least one coupling part which is present on the at least one of the support parts, is configured to establish a releasable connection to a wall construction element of the drawer, the wall construction element including at least one of a front part or a rear wall part, which is oriented so as to be transverse to the frame body.

8. The wall construction element according to claim 1, wherein when viewed in the longitudinal direction of the frame body at least one of the support parts is present in one of a front end portion and a rear end portion of the frame body.

9. The wall construction element according to claim 1, wherein at least one of the support parts is configured to be coupled to a cap-type wall element which is releasably attachable to the frame body.

10. A drawer having a wall construction element according to claim 1.

11. An item of furniture having a drawer according to claim 10.

12. A wall construction element of a drawer, wherein the wall construction element has a frame body, having a base part which provides a cavity for receiving a drawer guide system, and having a casing element for casing the base part, wherein in a covering portion of the frame body a material layer of the casing element covers a material layer of the base part, wherein a support part which upwardly projects in the fashion of a column is present on the frame body, wherein for attaching the support part in an end-side region of the frame body a projecting flat portion of the support part is secured between the base part and the casing element, wherein a first side of the flat portion of the support part in a connection region is connected in a planar manner to a material layer of the base part, and a second side of the flat portion of the support part is connected in a planar manner to a material layer of the casing element.

13. A wall construction element of a drawer, wherein the wall construction element has a frame body, having a base part which provides a cavity for receiving a drawer guide system, and having a casing element for casing the base part, wherein in a covering portion of the frame body a material layer of the casing element covers a material layer of the base part, wherein a support part which upwardly projects in the fashion of a column is present on the frame body, wherein for attaching the support part in an end-side region of the frame body a projecting flat portion of the support part is secured between the base part and the casing element, wherein a mechanically reinforced region in the covering portion which in relation to regions which are adjacent to the covering portion has an increased material thickness is provided by way of material layers which are connected in an overlapping manner.

* * * * *